US005176181A

United States Patent [19]

Bassi

[11] Patent Number: 5,176,181

[45] Date of Patent: Jan. 5, 1993

[54] SHED-FORMING DEVICE FOR GRIFFE FRAMES

[75] Inventor: Dario Bassi, Chaponnay, France

[73] Assignee: Etablissements Staubli-Verdol, Chassieu, France

[21] Appl. No.: 797,065

[22] Filed: Nov. 25, 1991

[30] Foreign Application Priority Data

Nov. 27, 1990 [FR] France ..... 90 15139

[51] Int. Cl.[5] ..... D03C 3/36

[52] U.S. Cl. ..... 139/55.1; 139/1 E; 139/62

[58] Field of Search ..... 139/66 R, 68, 71, 59, 139/65, 55.1, 58, 62, 79, 80, 81, 1 E, 329

[56] References Cited

U.S. PATENT DOCUMENTS

| | | | |
|---|---|---|---|
| 3,941,161 | 3/1976 | Neyraud | 139/1 E |
| 4,379,474 | 4/1983 | Mueller | 139/55.1 X |
| 4,532,963 | 8/1985 | Bastion et al. | 139/55.1 X |
| 5,092,369 | 3/1992 | Derudder | 139/65 |

*Primary Examiner*—Andrew M. Falik
*Attorney, Agent, or Firm*—Dowell & Dowell

[57] ABSTRACT

In a weaving loom, an assembly for controlling the reciprocating movement of the upper and lower frames of the shed-forming device which assembly includes a shaft of which the ends are each associated with the ends of two connecting rods by way of eccentrics and which connecting rods are articulated on rocking levers whose arms are pivotally associated with short and long levers attached respectively to the upper and lower frames of the shed-forming device.

6 Claims, 2 Drawing Sheets

SHED-FORMING DEVICE FOR GRIFFE FRAMES

BACKGROUND OF THE INVENTION

1. Field of the Invention

The present invention relates to improvements in or relating to the control of the reciprocating movement of the frames of a shed-forming device in a weaving loom, particularly of a weave mechanism.

The present invention aims at providing such for reciprocating the griffe frames which include knives which are engageable with hooks connected to the harness cords and pulleys for guiding the warp threads in a weaving loom. The control assembly is able to function at high speed because its low inertia.

2. History of the Related Art

Prior art shed-forming devices incorporating upper and lower griffe frames which are engagable with hooks associated with the harness cords for guiding warp threads in a weaving loom are disclosed in British patent 182,222 dated Mar 31, 1921.

SUMMARY OF THE INVENTION

The chassis of the device according to the invention which is traversed by a shaft whose ends which project beyond the chassis are each associated with the heads of two connecting rods via an eccentric, is characterized in that the feet of these connecting rods are articulated on the rod of a T-shaped rocking lever whose arms are pivotally associated, one, with a short lever and the other, with a long lever, attached in addition to the upper frame and to the lower frame, respectively.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
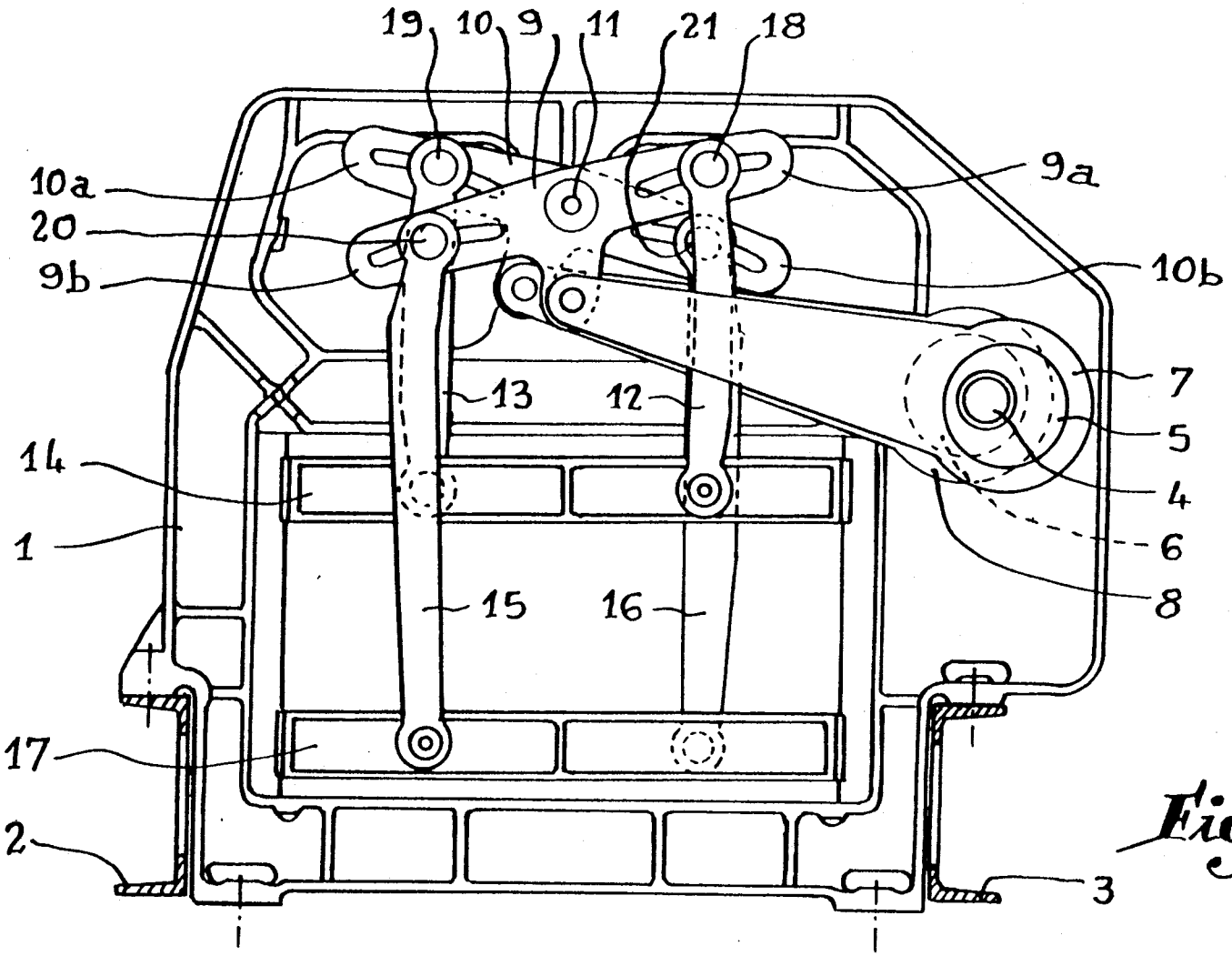
FIG. 1 is a view in elevation of a weave mechanism applying the improvements according to the invention.

Referring now to the drawings, FIG. 1 illustrates the chassis 1 of a weave mechanism resting on two supports 2 and 3 placed above a weaving loom (not shown). According to the invention, a shaft 4, suitably driven in synchronism with the shaft of the weaving loom passes through the chassis 1 and projects on each side thereof. On those parts of the shaft 4 projecting on either side of the chassis, there have been fitted two eccentrics 5, 6, each associated with the head of a connecting rod 7, 8 respectively. The foot of each connecting rod 7, 8 is respectively connected to the base of a lever 9, 10, each of which is substantially in the form of a T, and each of which is articulated about a transverse fixed shaft 11. It will be observed that, in a determined angular position of the shaft 4, levers 9 and 10 are angularly offset with respect to each other, with the result that the arms 9*a* and 10*a* are located substantially in the same horizontal plane, so that levers 12, 13 respectively associated with the arms and which are of the same length, support one of the sides of the upper frame 14 of the chassis 1.

In symmetrical manner, arms 9*b* and 10*b* of levers 9 and 10 lie substantially in the same horizontal plane, with the result that levers 15, 16 which are of the same length (but a length greater; than that of levers 12, 13) which are associated therewith by one of their ends, are attached by their other end to the lower frame 17 of the chassis 1.

In other words, each lever 9, 10 is associated with a short lever 12, 13 and with a long lever 15, 16, respectively.

It will be observed that the two arms of each lever includes longitudinal slots (not referenced) in which are fixed connectors 18, 19, 20, 21 on which levers 12, 13, 15 and 16 are respectively articulated.

Figure 2:
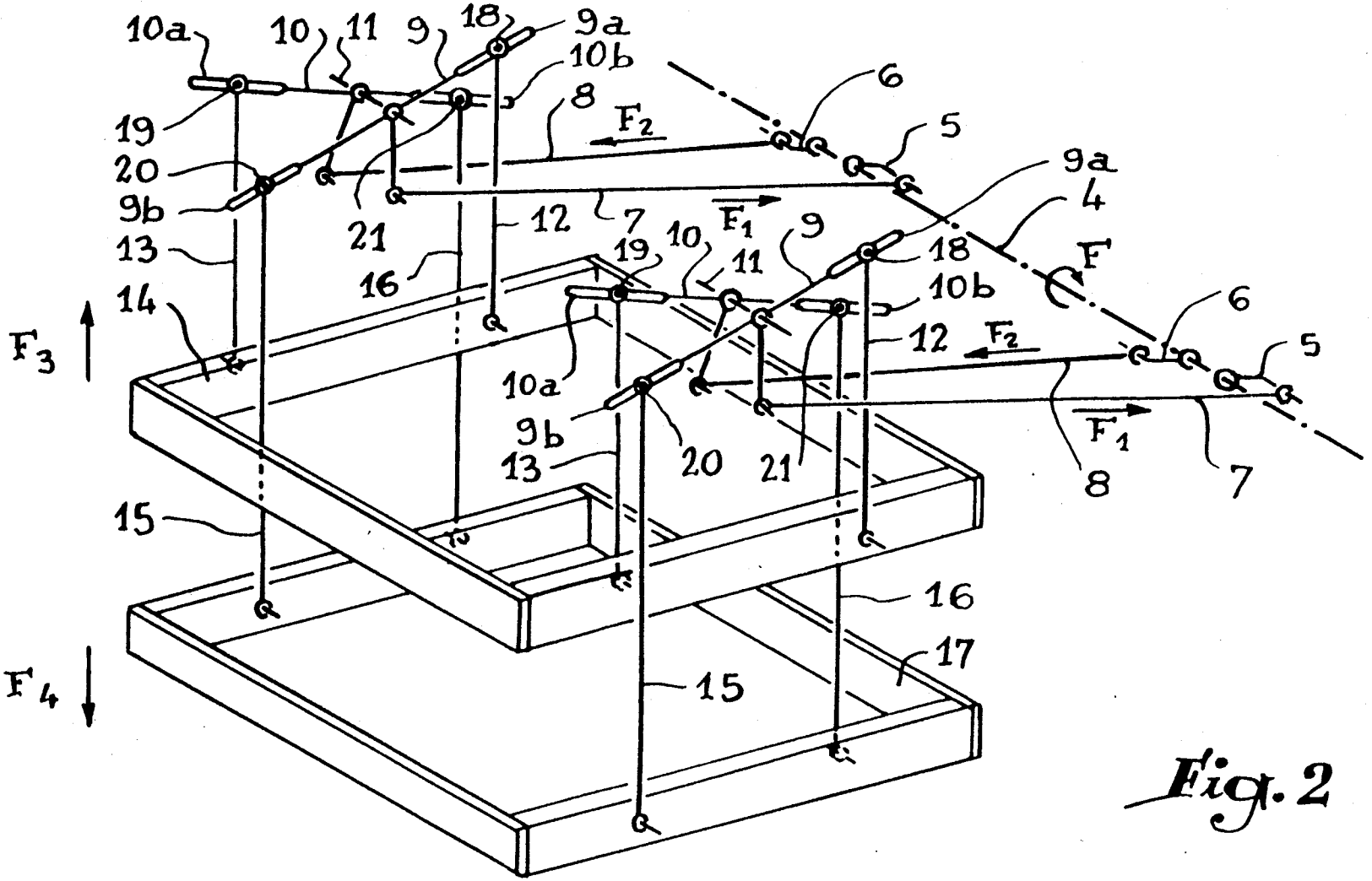
FIG. 2 schematically illustrates the different elements of the control assembly according to the invention.

If connectors 18 and 19 are exactly in the same horizontal plane, frame 14 is also horizontal, while frame 17 lies parallel to frame 14 if the connectors 20 and 21 are in the same horizontal plane lower than that containing the connectors 18, 19. If it is desired to obtain an oblique shed, it suffices to change the position of the connectors in their respective slot in order to orient the frames 14 and 17 obliquely with respect to each other. The diagram of FIG. 2 schematically shows the assembling of the control assembly according to the invention which includes two mechanisms such as the one described with reference to FIG. 1 and each located on either side of the chassis.

On each side of the chassis (not shown) are thus found two eccentrics 5, 6 actuating two connecting rods 7, 8 articulated on two T-shaped levers 9, 10. Rotation of shaft 4 in the direction of arrow F brings about displacements of connecting rods 7 and 8 in opposite directions, i.e. in the direction of arrows F1 and F2, with the result that the frames 14 and 17 move in reciprocating manner in opposition as illustrated by arrows F3 and F4 illustrating the displacement of the frames from their closest position.

It will be readily understood that the number of members necessary for the displacement of the frames being very reduced, the inertia of the control is low, with the result that the shaft 4 may rotate at high speeds. This reduced number of members reduces the general clearances which facilitate precision of the displacement of frames 14 and 17.

What is claimed is:

1. In a shed forming device for a weaving loom which includes a chassis having opposite sides and upper and lower griffe frames having opposite sides, and a control assembly for controlling the reciprocal movement of the griffe frames relative to the chassis, the control assembly comprising, a shaft having an end projecting beyond one of the opposite sides of the chassis, an eccentric means mounted to said end of said shaft, a pair of connecting rods having first and second ends, said first ends of said connecting rods being mounted to said eccentric means, a pair of rocking lever means pivotally mounted on the chassis, each rocking lever means having generally oppositely extending arm portions, a pair of short levers mounted to one of the sides of the upper griffe frame, a pair of long levers mounted to the lower griffe frame on one side thereof, connector means for connecting each of said short levers to one of said arm portions of each of said rocking lever means and each of said long levers to the other of said arm portions, and said second ends of said connecting rods being connected to said rocking levers.

2. The control assembly for a shed-forming device of claim 1 in which each of said arm portions of said rocking lever means include an elongated slot, said connector means being adjustable along the length of said slots to thereby alter the orientation of the griffe frames relative to the chassis.

3. The control assembly for a shed-forming device of claim 2 in which each of said rocking lever means is generally T-shaped.

4. The control assembly for a shed-forming device of claim 3 in which each of said short levers and each of said long levers are oriented in diagonal relationship with respect to one another.

5. The control assembly for a shed-forming device of claim 1 in which each of said rocking lever means is generally T-shaped.

6. The control assembly for a shed-forming device of claim 1 in which each of said short levers and each of said long levers are oriented in diagonal relationship with respect to one another.

* * * * *